US008141295B2

(12) United States Patent
Carrier

(10) Patent No.: US 8,141,295 B2
(45) Date of Patent: Mar. 27, 2012

(54) CASEMENT WINDOW OPERATOR

(76) Inventor: Christian Carrier, St-Nicholas (CA)

( * ) Notice: Subject to any disclaimer, the term of this patent is extended or adjusted under 35 U.S.C. 154(b) by 626 days.

(21) Appl. No.: 12/290,161

(22) Filed: Oct. 27, 2008

(65) Prior Publication Data

US 2010/0101148 A1 Apr. 29, 2010

(51) Int. Cl.
*E05D 15/40* (2006.01)

(52) U.S. Cl. ..... 49/249; 49/246; 49/248

(58) Field of Classification Search ..... 49/246, 49/247, 248, 249
See application file for complete search history.

(56) References Cited

U.S. PATENT DOCUMENTS

| | | | | | |
|---|---|---|---|---|---|
| 1,924,557 | A * | 8/1933 | Johnson | 49/341 |
| 2,214,280 | A * | 9/1940 | Lang | 74/89.14 |
| 4,845,830 | A * | 7/1989 | Nolte et al. | 29/432.1 |
| 4,887,392 | A * | 12/1989 | Lense | 49/300 |
| 4,894,902 | A * | 1/1990 | Tucker | 29/437 |
| 4,938,086 | A * | 7/1990 | Nolte et al. | 74/89.14 |
| 5,531,045 | A * | 7/1996 | Piltingsrud | 49/279 |
| 5,531,138 | A * | 7/1996 | Vetter | 74/606 R |
| 5,623,784 | A * | 4/1997 | Kuersten et al. | 49/342 |
| 5,802,913 | A * | 9/1998 | Winner | 74/89.18 |
| 5,839,229 | A * | 11/1998 | Briggs et al. | 49/246 |
| 6,122,863 | A * | 9/2000 | Tippin et al. | 49/279 |
| 6,128,858 | A * | 10/2000 | Vetter et al. | 49/342 |
| 6,247,270 | B1 * | 6/2001 | Huml | 49/341 |
| 6,374,544 | B1 * | 4/2002 | Ellis | 49/249 |
| 6,634,141 | B2 * | 10/2003 | Anderson et al. | 49/342 |
| 6,672,010 | B1 * | 1/2004 | Gledhill et al. | 49/341 |
| 6,915,608 | B2 * | 7/2005 | Labarre | 49/140 |
| 7,464,619 | B2 * | 12/2008 | Vetter | 74/396 |
| 2003/0172591 | A1 * | 9/2003 | Labarre | 49/248 |

* cited by examiner

*Primary Examiner* — Jerry Redman
(74) *Attorney, Agent, or Firm* — Eric Fincham

(57) ABSTRACT

An operator for a casement window, the operator comprising a base, at least one arm for securement to the base, an upper securement member extending through an aperture in the base and an end of the arm with the securement member having a threaded recess therein. A lower screw securement member is screw threadedly engaged with the upper one to assist in drawing the arm into the desired position. A monocoque housing surrounds the operator and has sealing members to prevent air infiltration.

14 Claims, 8 Drawing Sheets

CASEMENT WINDOW OPERATOR

FIELD OF THE INVENTION

The present invention relates to windows and more particularly, relates to a window operator such as is typically used in casement windows.

BACKGROUND OF THE INVENTION

A casement window has a window sash which is moveably mounted within a frame by a pair of hinges mounted between the window frame the top and bottom of the window sash. Normally, the arrangement is such that one has a track mountable to the window frame and a sash arm connectable to the window sash. A support arm interconnects the track and the sash window with the support arm being pivotably connected to the sash arm and to the track. The sash arm is pivotably connected to a mounting shoe which is supported and guided for movement lengthwise of the track.

It is also known to provide an intervening link between the sash arm and the moveable shoe to provide for an offset sash arm. Such an arrangement typically includes a second intervening link between the support arm and the moveable shoe to provide further support.

Casement window operators are well known and typically include a hand crank which drives a worm gear arrangement which is connected to an arm or lever which pushes the window sash open. The worm gear assembly includes a gear shaft having the worm at one end thereof with the other end of the gear shaft extending outwardly through the housing to engage a crank. When the crank is turned, the worm causes the worm wheel to rotate and which in turn causes the sash to pivot on its hinges between open and closed positions.

As aforementioned, there are different opening arrangements for casement windows. A first type is a single arm operator which has an arm which pivots about an axis that is fixed with respect to the window frame and worm gear. The remote end of the arm carries a bearing which slides in a track mounted to the underside of the sash. A disadvantage with single arm operators is the torque required to move the sash towards its fully open position.

A second type of casement operator is the split arm variety. A split arm operator includes a second arm which has a pivot point in the middle of the second arm and the remote end of the second arm is secured through a pivotable mounting to a fixed point on the sash. While a split arm operator allows the window to extend to its fully open position, it does present difficulty at the time of the initial opening of the sash.

A third type of window operator is a dual arm operator which has one arm which rotates about a fixed axis and a housing which carries at its far end a bearing to slide in the track mounted to the window sash. There is also a second arm which has a pivot joint and which is secured at its remote end by a pivotable but fixed connection to the sash.

Many of the operators described above are relatively complex and difficult to assemble such that they will function in a reliable manner. A further problem in northern climates is the tendency of the operator to permit infiltration of cold air thus driving up energy costs.

SUMMARY OF THE INVENTION

It is an object of the present invention to provide a window operator which overcomes some of the disadvantages of the prior art.

According to one aspect of the present invention, there is provided an operator for a window comprising a base having a top and a bottom, the base having means for attachment to a window sash, an aperture extending through the base, an arm having first and second ends, the first end being secured to the base, the first arm having an aperture therein overlying the aperture in the base, an upper securement member extending at least partially through the aperture in the first end of the arm, the securement member having a threaded recess therein, a lower securement member screw threadedly engaged with the upper securement member and extending through the base in an abutting relationship thereto.

The operator is used with casement windows wherein the window is hinged on the side between the top and bottom of the window sash. The operator of the present invention may be utilized with a single arm, split arm or dual arm arrangement.

The operator preferably uses a worm wheel formed at a first end of an arm and which worm wheel is designed to engage a worm formed at one end of a shaft. The arrangement is such that the arm is secured to the base by upper and lower securement members which are screw threadedly engaged with each other. In this regard, the top securement member has a recess formed therein which is designed to receive the lower securement member. This arrangement allows the arm to be "drawn down" as the screw (bolt) is tightened.

The above arrangement allows the use of a monocoque housing secured to the base. The monocoque housing can, in colder climates, substantially reduce infiltration of cold air. Preferably sealing members are utilized to provide a substantially air tight enclosure.

For ease of operation, there is preferably provided a ball bearing at the end of the shaft having the worm such that ease of operation is enhanced.

In one embodiment of the invention, a locking mechanism is incorporated with the operator within the same housing. The locking mechanism preferably includes a lever which is connected to an actuator with a link extending between the acutator and a multi-point tie bar. The link preferably is associated with a plurality link guides for guiding the line along a predetermined path, and which predetermined path includes a turn through 90°.

BRIEF DESCRIPTION OF THE DRAWINGS

Having thus generally described the invention, reference will be made to the drawings illustrating an embodiment thereof, in which.

DETAILED DESCRIPTION OF THE INVENTION

Figure 1:
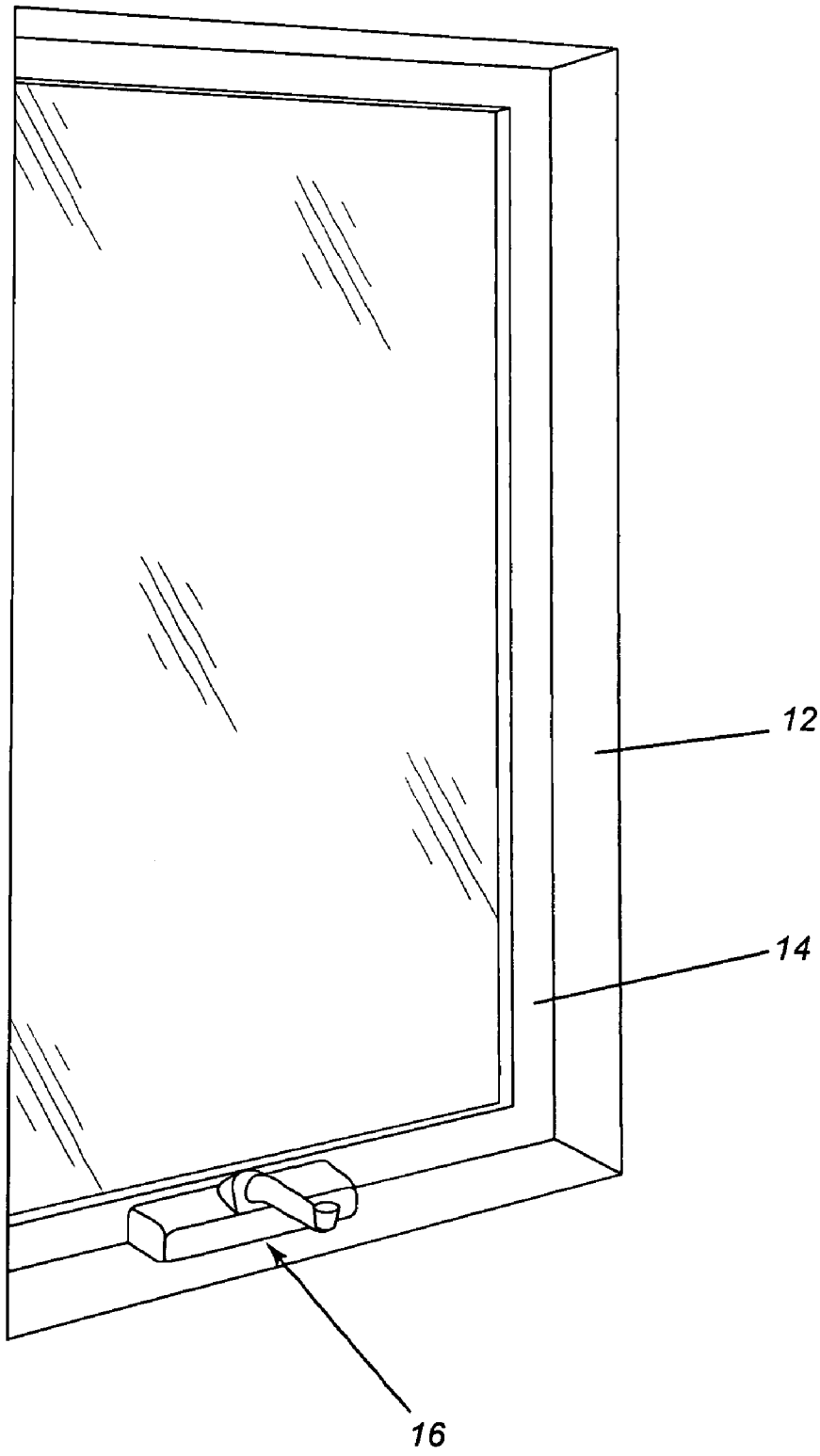
FIG. 1 is a perspective view of a window assembly utilizing the operator of the present invention.

Referring to the drawings in greater detail and by reference characters thereto, there is illustrated in FIG. 1 a window generally designated by reference numeral 10 and which window 10 includes a window frame 12 and a sash 14. An operator 16 is utilized to open and close a window which is of the casement type.

Figure 2A:
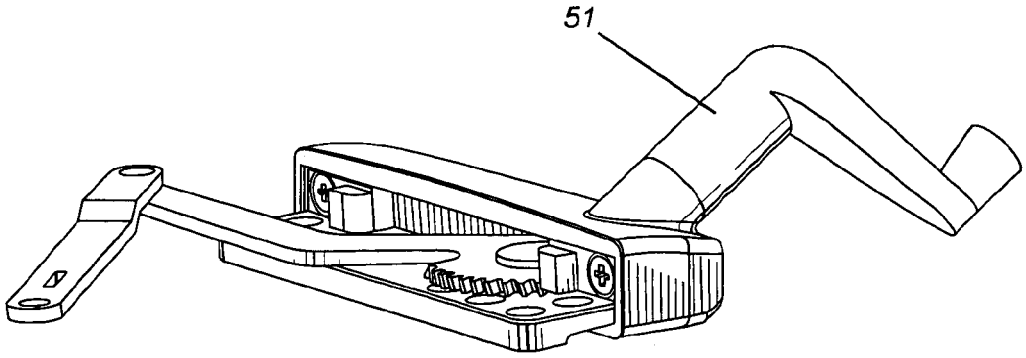
FIG. 2*a* is a perspective view of the window operator.
Figure 2B:
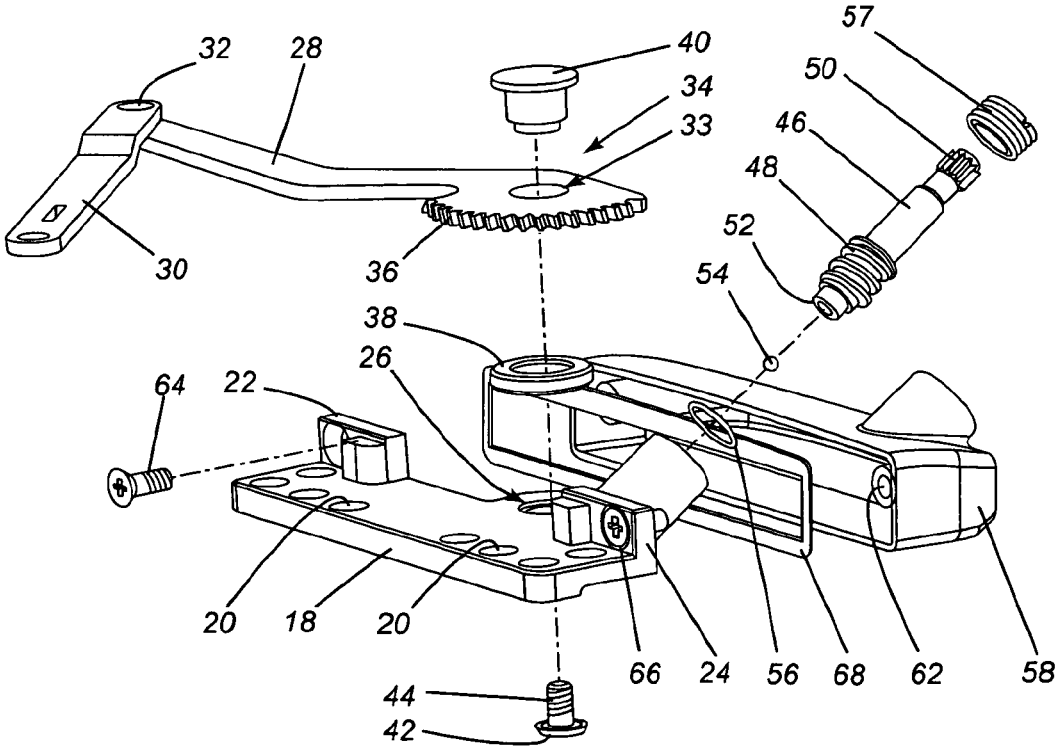
FIG. 2*b* is an exploded view thereof.

Operator 16, as may be better seen in FIGS. 2*a* and 2*b*, includes a base 18 which has a plurality of mounting apertures 20. As is conventional, base 18 may be secured to the window frame by screws or other suitable mechanical fasteners.

Mounted on the upper side of base 18 are posts 22 and 24 for reasons which will become apparent hereinbelow. Base 18 also has a aperture 26.

In the illustrated embodiment, operator 16 includes a first arm 28 and a second arm 30. Arms 28 and 30 are conventional in the art of window operators. Arms 28 and 30 are secured by rivet 32.

Arm 28 has a first end generally designated by reference numeral 34 and forms a portion of a worm wheel 36, as is well known in the art. It will be noted that there is provided an aperture 33 in worm wheel 36 and which aperture 33 overlies aperture 26. A shim 38 is placed between worm wheel 36 and base 18.

An upper securement member 40 works in conjunction with a lower securement member 42 to secure arm 28 in position. In this regard, upper securement member 40 has a threaded recess which is designed to screw threadedly engage with threads 44 on lower securement member 42. In this arrangement, the lower securement member 42, upon tightening the same, draws upper securement member 40 downwardly into position to maintain a secure connection therebetween.

A shaft 46 has a worm 48 formed at one end thereof. At the opposed end, there is provided a spur gear 50 and worm screw 57 which is designed to engage with a handle 51.

Shaft 46, at the end proximate worm 48, has a recess 52 which is designed to receive a ball bearing 54 to allow for easy turning of shaft 46. A thermal seal 56 is also provided to prevent the passage of air from the interior of operator 16.

Operator 16 also includes a monocoque housing 58 which has two internally threaded cylinders 60, 62 which are designed to receive screws 64, 66 passing through post 22 and 24 to thereby mount the base 18 to the monocoque housing 58.

Ideally, a sealing member 68 is provided for thermal sealing against sash 14.

Figure 3A:
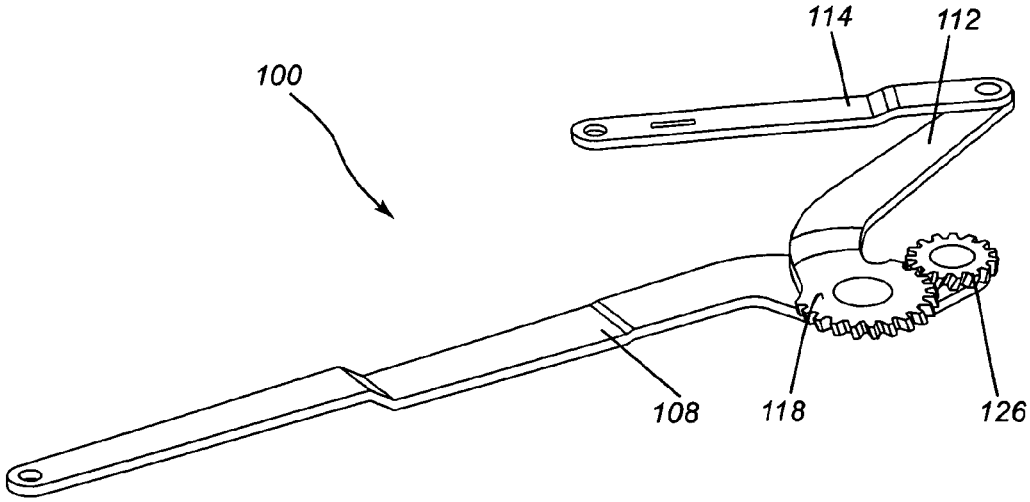
FIG. 3*a* is a perspective view of a portion of the operator utilized with a double arm arrangement.
Figure 3B:
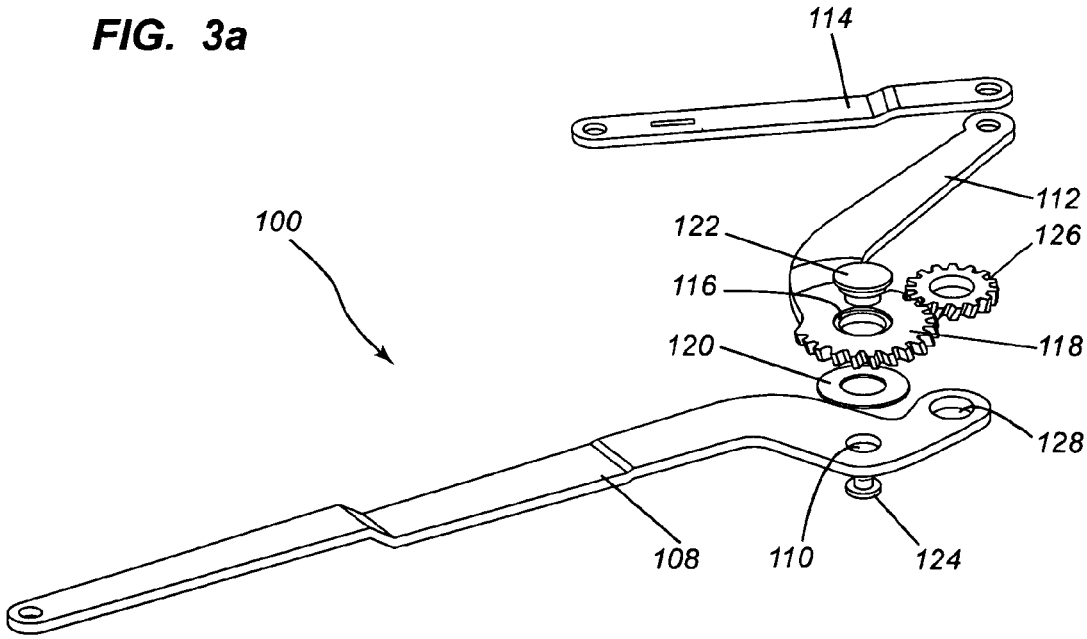
FIG. 3*b* is an exploded view thereof.
Figure 4:
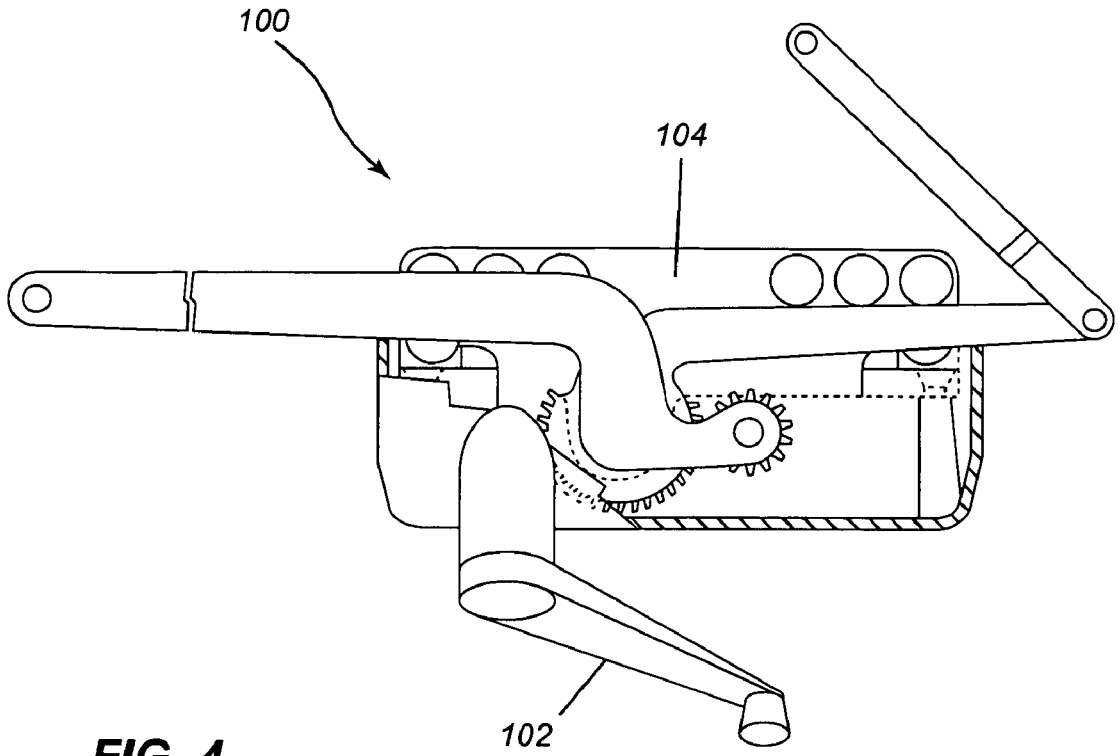
FIG. 4 is a top plan view of the operator of FIGS. 3*a* and 3*b*.
Figure 5:
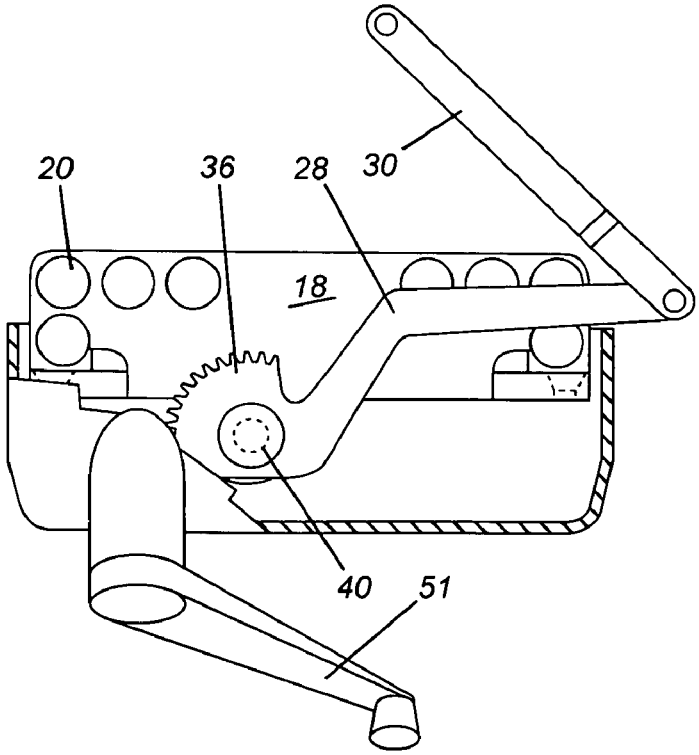
FIG. 5 is a top plan view of the operator of FIGS. 2*a* and 2*b*.
Figure 6:
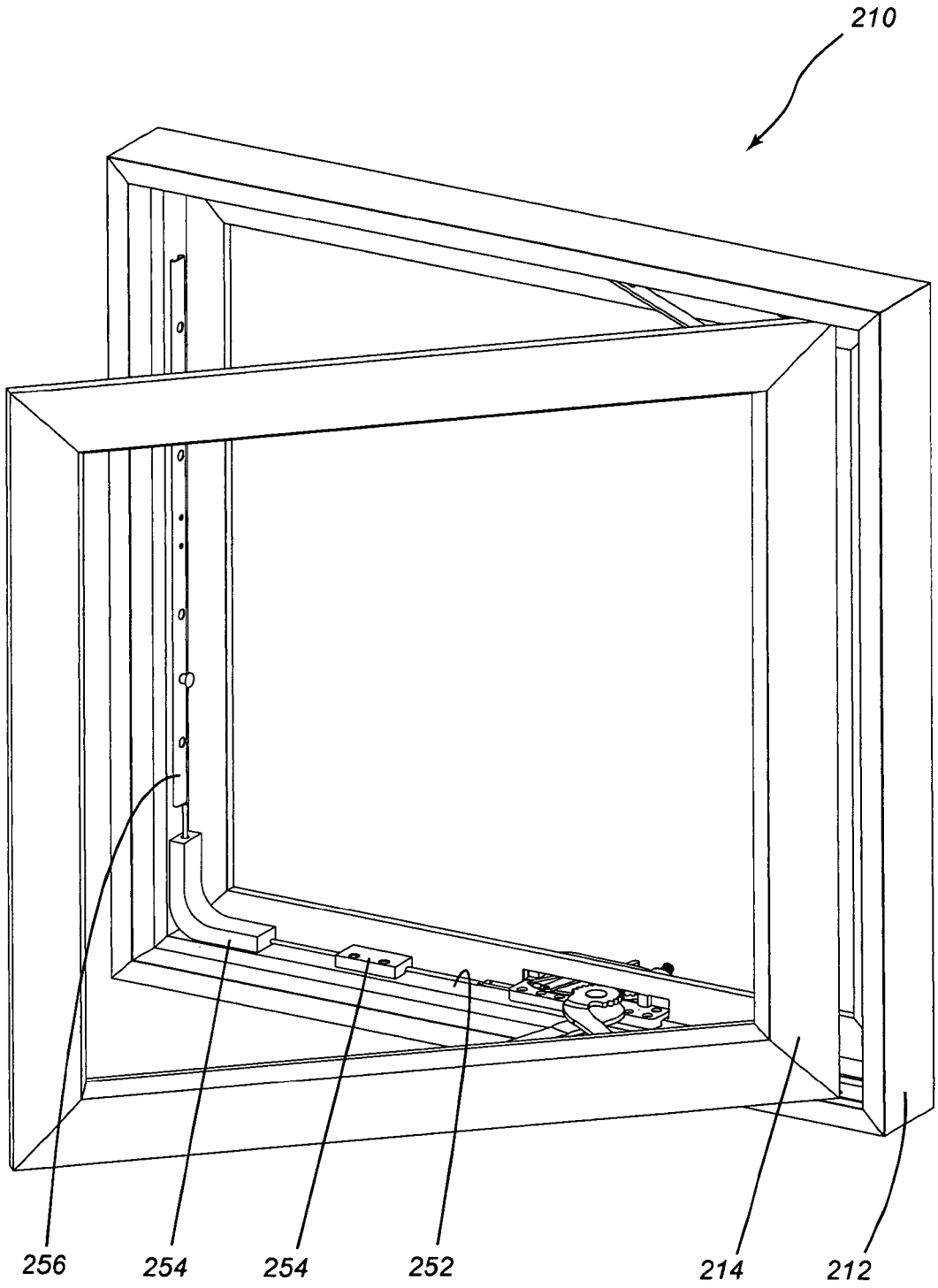
FIG. 6 is a perspective view of a window utilizing a second embodiment of an operator according to the present invention'
Figure 7:
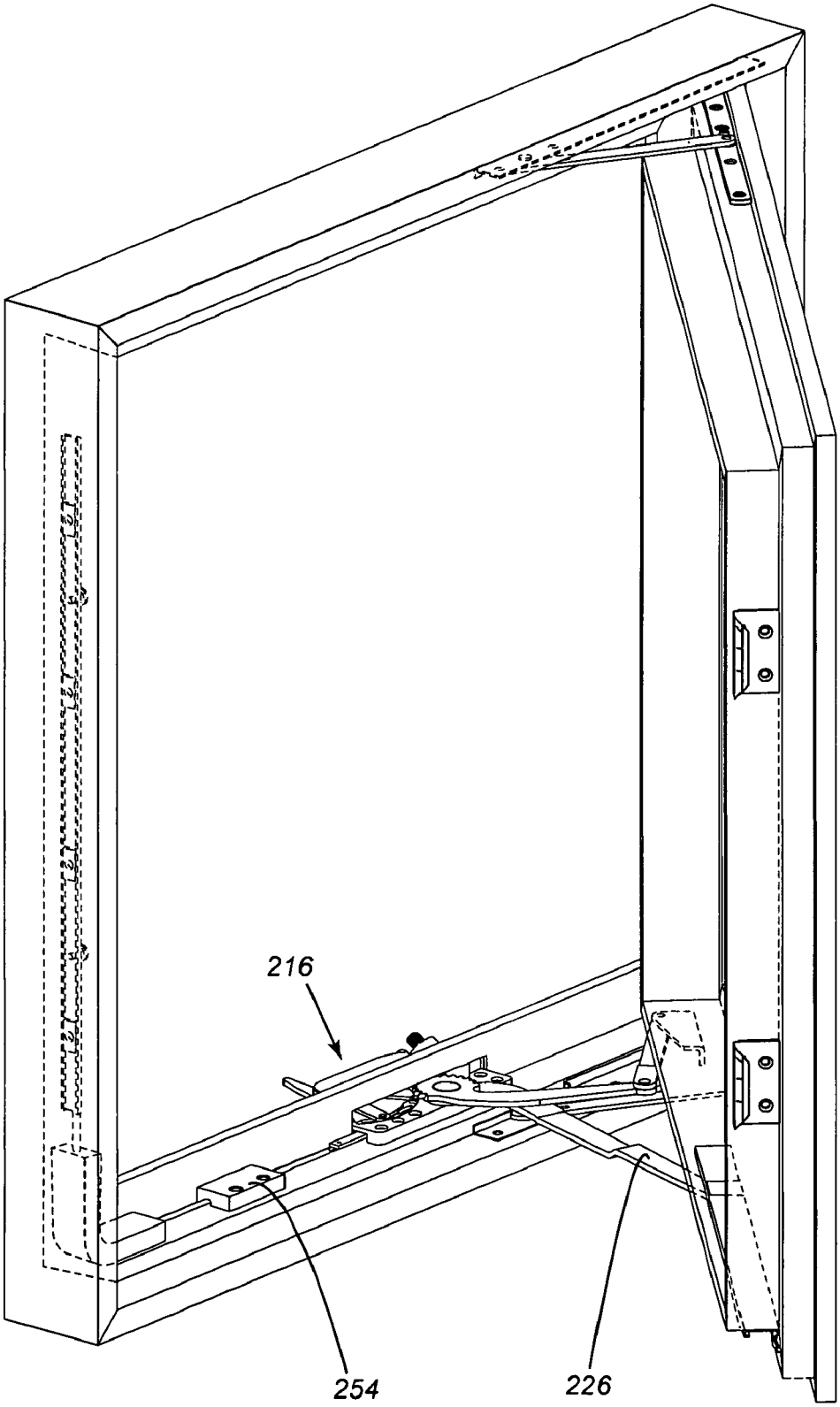
FIG. 7 is a perspective view from the other side thereof.
Figure 8:
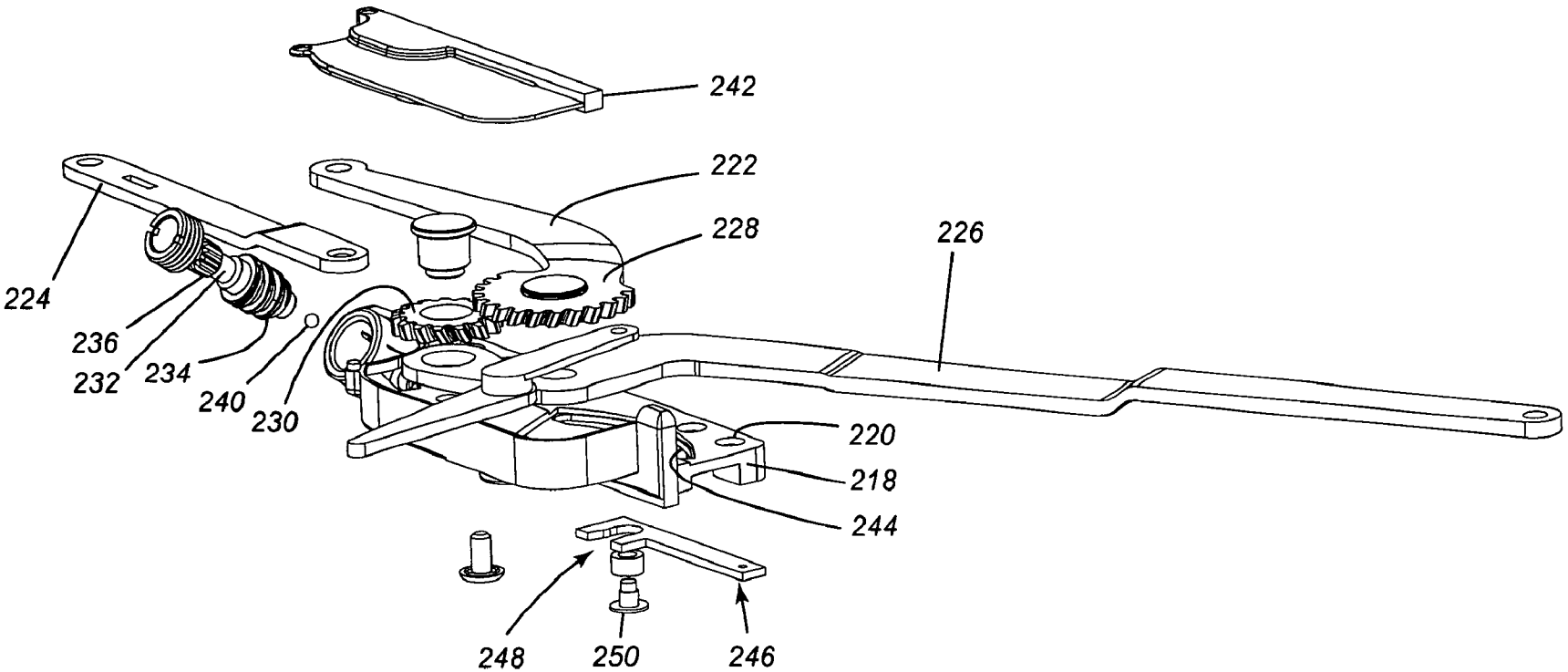
FIG. 8 is an exploded view of the operator.

Turning to the embodiment of FIGS. 3A, 3B and 4, there is illustrated a double arm operator and which double arm operator is generally designated by reference numeral 100. Double arm operator 100 includes a handle 102 and a base 104 which has a plurality of mounting apertures 106.

A first arm 108 includes a mounting aperture 110 formed therein. A second arm 112 has a second arm extension 114 as in the previously described embodiment. A mounting aperture 116 is formed in the center of worm wheel 118. A shim 120 is mounted between second arm 112 and first arm 108. As in the previously described embodiment, there is provided an upper securement member 122 and a lower securement member 124 which are screw threadedly engaged with each other.

In this embodiment, there is provided a second worm wheel 126 while as may be seen in FIG. 3B, there is provided an aperture 128 for mounting of worm wheel 126. In this regard, it may be mounted in the same manner as previously described with use of upper and lower securement members.

As may be seen in FIG. 4, the worm drives worm wheel 118 which in turn will drive worm gear 126 in a conventional manner.

Referring to the embodiment of FIGS. 6 to 10, there is illustrated a window 210 having a frame 212 and sash 214. An operator 216 is provided for opening and closing the window.

Operator 216 includes a base 218 having mounting apertures 220 formed therein. The operator also includes a first arm 222 and a first arm extension 224 along with a second arm 226, all as described in the previous embodiment.

As in the previously described embodiment, there is also provided a first worm wheel 228 and a second worm wheel 230. Worm wheel 230 is driven by a shaft 232 having a worm 234 at one end thereof and a spur gear 236 at the other end thereof. For ease of turning, a ball bearing 240 is located at the bottom of shaft 232.

The operator will include a housing 242 while in base 218, there is provided an arcuate slot 244.

An actuator 246 includes a U-shaped recess 248 designed to receive a pin 250 which extends through to slot 244. Connected to actuator 246 is a link 252 which passes through link guides 254 to be secured to tie bar 256.

Figure 9:
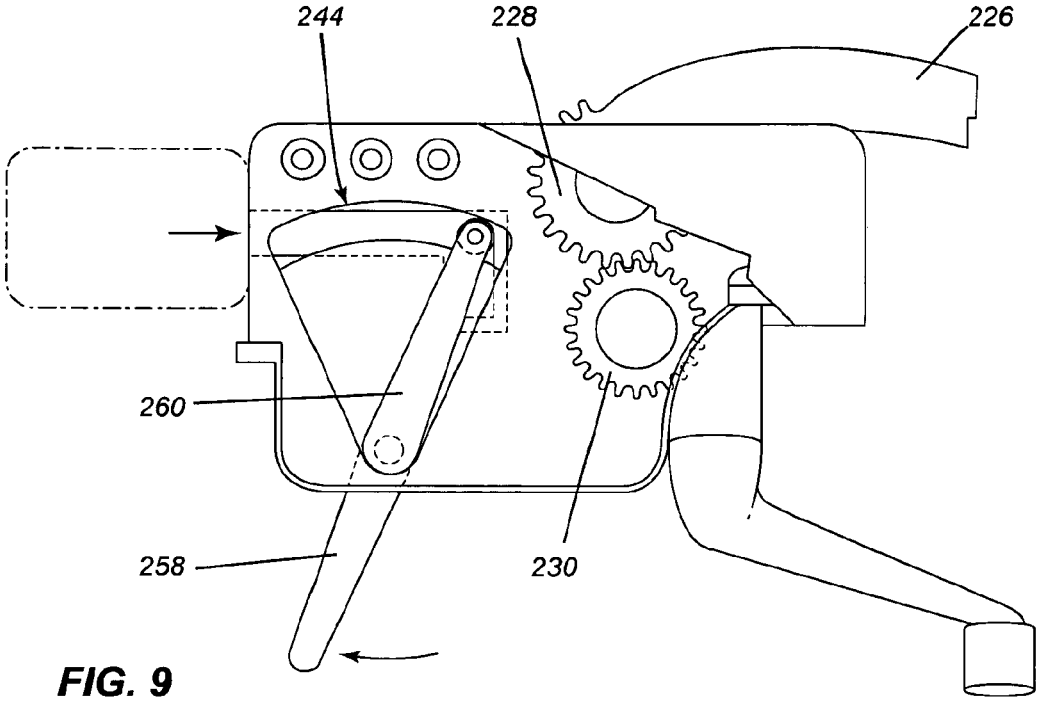
FIG. 9 is a bottom plan view, partially in cut-away of the operator when in a closed position.
Figure 10:
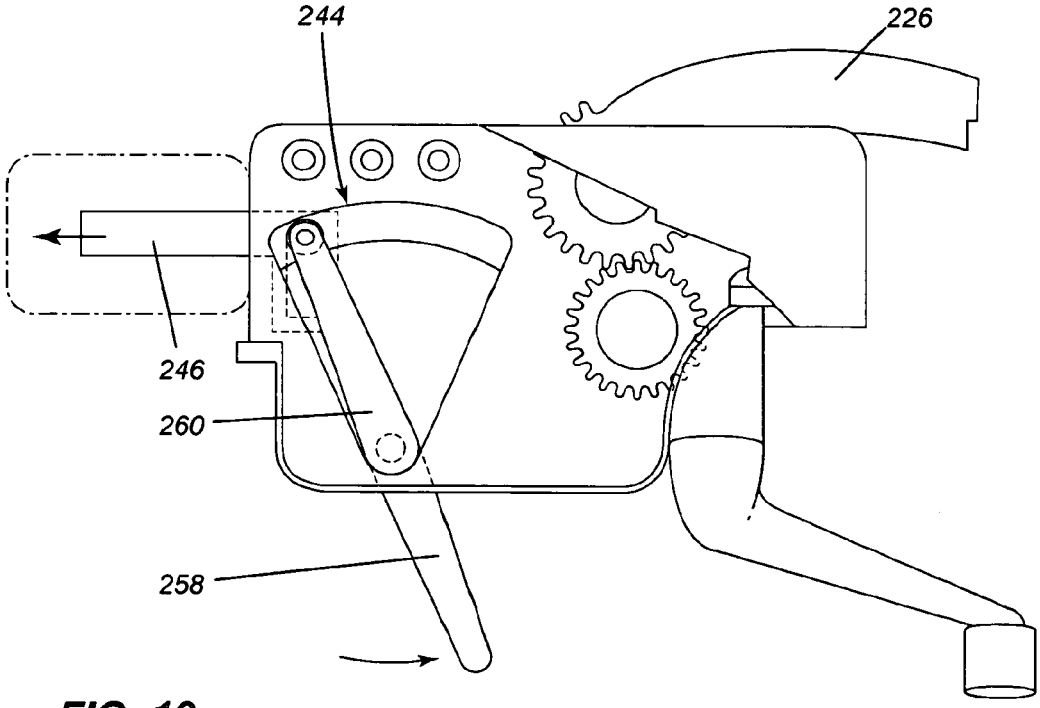
FIG. 10 is a view similar to FIG. 9 when the operator is in an open position.

Actuator 246 is operatively connected to an exterior lever 258 and an interior lever 260 which moves actuator 246 between locked and unlocked positions and shown in FIGS. 9 and 10.

It will be understood that the above described embodiments are for purposes of illustration only and that changes and modifications may be made thereto without departing from the spirit and scope of the invention.

I claim:

1. An operator for a window comprising:

a base having a top and a bottom, said base having means for attachment to a window sash, an aperture extending through said base;

an arm having first and second ends, said first end being secured to said base, said first arm having an aperture therein overlying said aperture in said base;

an upper securement member extending at least partially through said aperture in said first end of said arm, said securement member having a threaded recess therein;

a lower securement member screw threadedly engaged with said upper securement member and extending through said base in an abutting relationship thereto; and a multipoint tie bar operative to engage the window to lock said window, and a mechanism extending between said operator and said multi-point tie bar, said mechanism being operative to move said tie bar between open and locked positions.

2. The operator of claim 1 wherein said first end of said arm has a worm wheel formed thereon.

3. The operator of claim 2 further including a shaft having a worm operatively connected to said worm wheel.

4. The operator of claim 3 further including a monocoque housing, said monocoque housing being secured to said base, said monocoque housing completely surrounding said top and bottom of said base, said monocoque housing being open at an end designed to abut the window sash.

5. The operator of claim 4 further including a sealing member at said one end of said monocoque housing.

6. The operator of claim 3 further including a ball bearing located at the end of said shaft having said worm.

7. The operator of claim 6 wherein said shaft extends through said monocoque housing and further including a seal extending about said shaft.

8. The operator of claim 1 further including a shim mounted between said upper securement member and said arm.

9. The operator of claim 1 further including a second arm, said second arm being pivotably connected to said first arm proximate said first end thereof, said second arm having a worm wheel formed thereon.

10. The operator of claim 1 wherein said mechanism comprises a slot formed in said base, an actuator engageable within and guided by said slot, a lever connected to said actuator, and a link extending between said actuator and said multi-point tie bar.

11. The operator of claim 10 wherein said slot formed in said base has an elongated arcuate configuration.

12. The operator of claim 11 further including a plurality of link guides for guiding said link along a predetermined path.

13. The operator of claim 12 wherein said guides include at least one guide to guide said link through an angle of 90 degrees.

14. The operator of claim 13 wherein said link is connected to said actuator to permit movement of said actuator.

* * * * *